US007731612B2

(12) United States Patent
Martin

(10) Patent No.: US 7,731,612 B2
(45) Date of Patent: Jun. 8, 2010

(54) ARROW LAUNCHED MEDIA RESERVOIR

(76) Inventor: John C. Martin, 1131 Lyonhurst, Birmingham, MI (US) 48009

( * ) Notice: Subject to any disclaimer, the term of this patent is extended or adjusted under 35 U.S.C. 154(b) by 0 days.

(21) Appl. No.: 11/956,023

(22) Filed: Dec. 13, 2007

(65) Prior Publication Data

US 2008/0096702 A1 Apr. 24, 2008

Related U.S. Application Data

(63) Continuation-in-part of application No. 11/470,669, filed on Sep. 7, 2006, which is a continuation-in-part of application No. 11/153,136, filed on Jun. 15, 2005.

(60) Provisional application No. 60/870,525, filed on Dec. 18, 2006, provisional application No. 60/889,679, filed on Feb. 13, 2007, provisional application No. 60/894,707, filed on Mar. 14, 2007, provisional application No. 60/727,469, filed on Oct. 17, 2005, provisional application No. 60/742,298, filed on Dec. 5, 2005, provisional application No. 60/762,652, filed on Jan. 27, 2006, provisional application No. 60/771,155, filed on Feb. 27, 2006, provisional application No. 60/580,618, filed on Jun. 17, 2004.

(51) Int. Cl.
*F42B 6/04* (2006.01)

(52) U.S. Cl. ..... 473/581; 473/582

(58) Field of Classification Search ..... 473/578, 473/581, 582
See application file for complete search history.

(56) References Cited

U.S. PATENT DOCUMENTS 2,982,549 A * 5/1961 Libow ..... 473/576
3,190,654 A * 6/1965 Ross ..... 273/378
3,528,662 A * 9/1970 Engle et al. ..... 473/577
3,672,677 A * 6/1972 Moore ..... 473/578
4,726,584 A 2/1988 Bishop
4,881,743 A 11/1989 Fiorenzo
5,033,446 A 7/1991 Bradt
5,035,183 A 7/1991 Luxton
5,035,435 A 7/1991 Burgeson et al.
5,123,657 A 6/1992 Colt et al.
5,183,259 A 2/1993 Lyon
5,303,496 A 4/1994 Kowalkowski
5,456,036 A 10/1995 Butz
5,515,785 A 5/1996 Zglenicki
5,669,836 A 9/1997 Hill
5,836,842 A 11/1998 McLearan
5,928,049 A 7/1999 Hudson
6,142,895 A 11/2000 Jason
6,159,117 A * 12/2000 Chan ..... 473/574
6,174,251 B1 1/2001 Lemote
6,450,905 B1 9/2002 Edlund

* cited by examiner

*Primary Examiner*—John Ricci
(74) *Attorney, Agent, or Firm*—Howard & Howard Attorneys PLLC

(57) ABSTRACT

An arrow having an arrowhead assembly attached thereto is provided for marking a remote location with a marking media. The marking media is preferably in the form of a paint ball or a scent ball. The arrowhead assembly includes a media reservoir defining a cavity and a plurality of supports extending outward from the media reservoir along a longitudinal axis. The supports secure the marking media within the cavity in a press-fit connection. In one embodiment, a cap and a resilient nose cone are attached to the media reservoir, surrounding the marking media, to prevent damage to a target upon impacting the target.

19 Claims, 16 Drawing Sheets

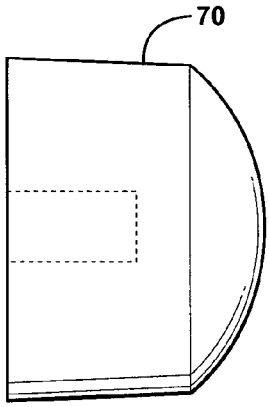
FIG - 13
FIG - 14
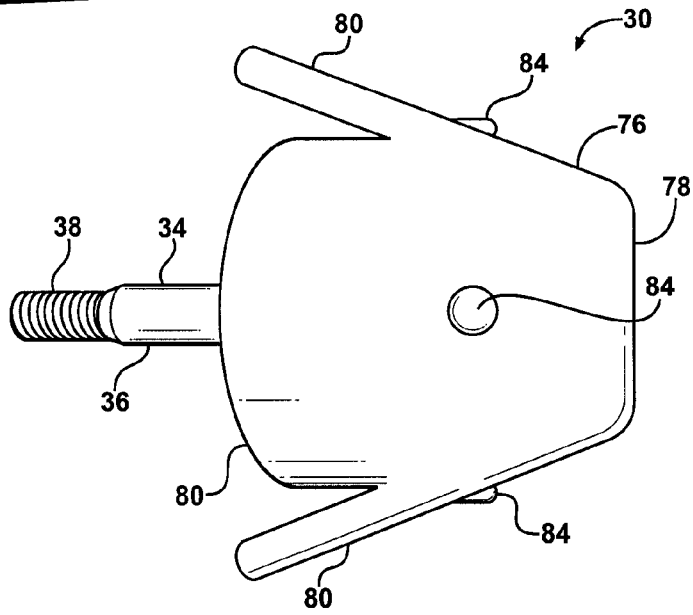
FIG - 15
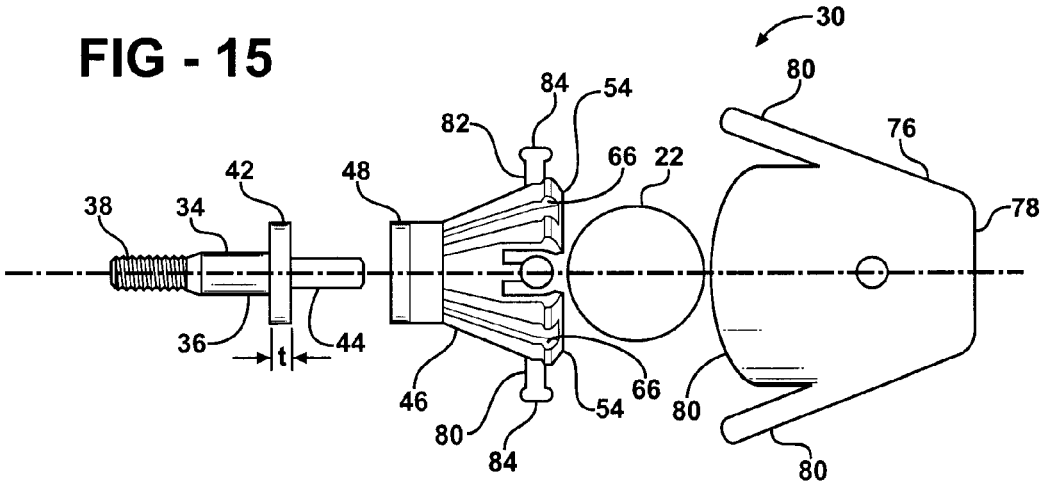

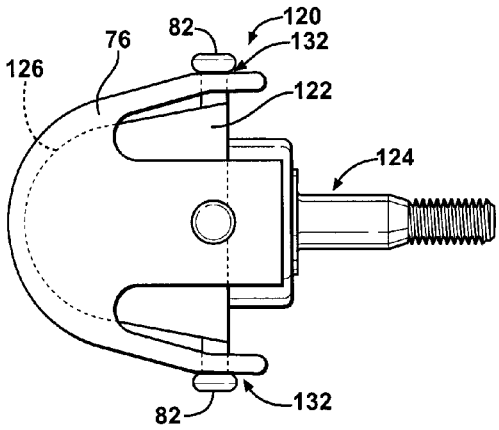
FIG - 23
FIG - 24
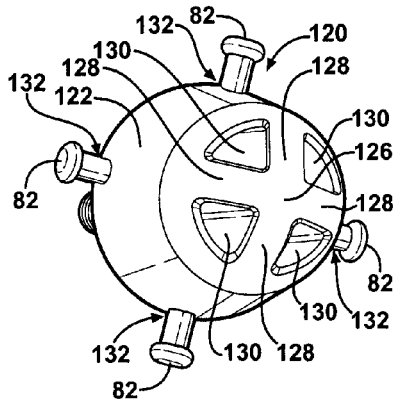
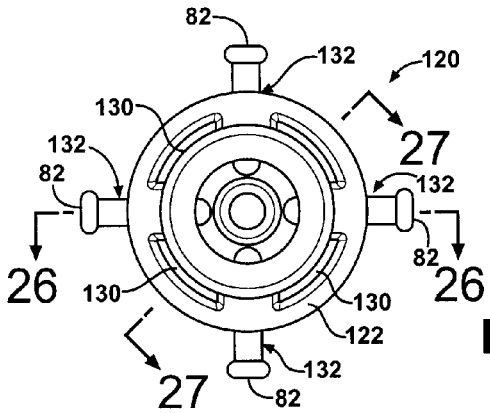
FIG - 25
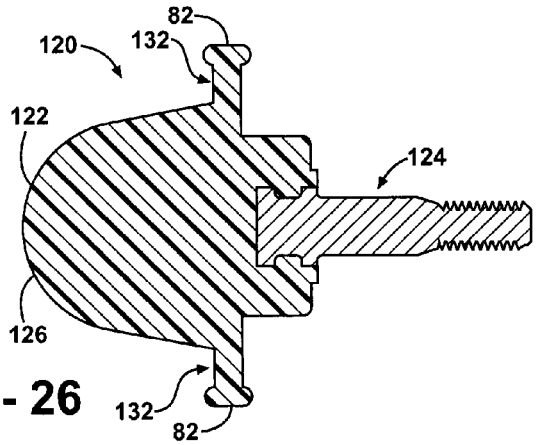
FIG - 26

ARROW LAUNCHED MEDIA RESERVOIR

CROSS REFERENCE TO RELATED APPLICATION

This application claims the benefits of U.S. provisional patent application Ser. No. 60/870,525 filed on Dec. 18, 2006, U.S. provisional patent application Ser. No. 60/889,679 filed on Feb. 13, 2007, and U.S. provisional patent application Ser. No. 60/894,707 filed on Mar. 14, 2007, the advantages and disclosure of each are hereby incorporated by reference; and is a continuation-in-part of prior non-provisional patent application Ser. No. 11/470,669 filed on Sep. 7, 2006, which claims the benefits of U.S. provisional patent application Ser. No. 60/727,469 filed on Oct. 17, 2005, U.S. provisional patent application Ser. No. 60/742,298 filed on Dec. 5, 2005, U.S. provisional patent application Ser. No. 60/762,652 filed on Jan. 27, 2006, and U.S. provisional patent application Ser. No. 60/771,155 filed on Feb. 27, 2006, the advantages and disclosure of each are also hereby incorporated by reference; and is a continuation-in-part of prior non-provisional patent application Ser. No. 11/153,136 filed Jun. 15, 2005 that claims the benefits of U.S. provisional patent application Ser. No. 60/580,618 filed on Jun. 17, 2004.

BACKGROUND OF THE INVENTION

1. Field of the Invention

The subject invention generally relates to an arrow, and more specifically to an arrowhead assembly attached to the arrow for remotely delivering a marking media to a remote location.

2. Description of the Prior Art

Many millions of people around the world enjoy the sport of archery. Of these, over four (4) million hunters in the United States alone take to the field each year to hunt big game, i.e., deer, elk, etc., or to practice their shooting skills by "stump shooting", i.e., shooting at trees, fence posts, tree stumps, etc.

Those archers who enjoy stump shooting are currently restricted to using arrowheads that are not effective in providing immediate feedback regarding shot placement or, if the feedback is rapid, the archer is faced with the time consuming task of trying to extract the arrowhead from the woodland target.

U.S. Pat. No. 6,142,895 (the '895 patent) discloses an arrow having a marking head for providing feedback regarding shot placement of the arrow. The arrow includes a shaft and a receiving plug attached to one end of the shaft. An arrowhead connector is in threaded engagement with the receiving plug, and supports a base thereon. The base is formed of a hard rubber or plastic and includes a concavity in a front end thereof for seating a paint ball therein. An adhesive secures the paint ball to the base. Upon the arrow impacting the surface, the paint ball ruptures, marking the target with the paint.

For those archers who enjoy the sport of bow hunter, the use of a marking media, such as a "scent", is a common tool. The scent can be in the form of a cover scent, e.g., skunk scent, fox urine, etc., meant to mask the scent of the hunter, or alternatively, it may be in the form of an attractor scent, e.g., a doe-in-heat scent, etc., designed to lure a buck to a certain spot in the forest where the buck believes a doe may be ready to mate.

Currently, the preferred method of delivering attractor scents involves the hunter going to a spot in the forest and "dropping" scent at the location. The method of dropping the scent generally takes the form of applying the scent to a felt pad and leaving the pad suspended from a tree branch or by simply placing the pad on the ground. The risk associated with this method of dropping the scent is that while the hunter is placing the attractor scent, by the very nature of being at the location, the hunter is also leaving their human scent along the way. Human scent is not an attractor scent for most game species, and actually tends to repel most game species.

Alternative methods of delivering the attractor scents have been developed. One such method includes incorporating a scent with an arrow, allowing the hunter to launch the arrow into the location without actually entering the location, thereby permitting the hunter to avoid leaving their human scent at the location where the attractor scent is applied. This method of delivering the scent may be referred to as an airborne delivery method. An example of an arrow utilized in such an airborne delivery method is disclosed in U.S. Pat. No. 4,881,743 (the '743 patent) to Fiorenzo, titled "Scent Head Arrow".

Alternatively, U.S. Pat. No. 5,303,496 (the '496 patent) to Kowalkowski, titled "Scent Distributing Method For Hunters", discloses a method of delivering a scent by encapsulating the scent in a plastic or gelatin walled pellet. The pellet may be in the form of a scent ball, similar to a paint ball utilized in a compressed air gun, and delivered by an arrow as described above in the '895 patent. Upon the arrow impacting a surface, the scent ball ruptures, spreading the desired scent onto the surface.

The arrow described in the '895 patent is capable of delivering a marking media, such as the paint ball or the scent ball, to a remote location. However, the marking media must be attached to the arrow by an adhesive before use, allowing sufficient time for the adhesive to dry. This is both time consuming and messy. Additionally, care must be taken to protect the arrow once the marking media is attached thereto to prevent the marking media from rupturing while transporting the arrow prior to use.

SUMMARY OF THE INVENTION AND ADVANTAGES

The subject invention provides an arrow for remotely delivering a marking media to a location. The arrow comprises a shaft having a nock end and extending along a longitudinal axis to an opposing distal end. A media reservoir includes a base attached to the distal end of the shaft, and defines a cavity. At least one support extends outwardly from the base of the media reservoir along the longitudinal axis. The at least one support secures the marking media within the cavity of the media reservoir, between the at least one support, in a press-fit connection.

Accordingly, the subject invention provides an arrow capable of securing the marking media, such as a paint ball or a scent ball, within the cavity by simply pressing the marking media into the cavity between the supports, and does not require the use of an adhesive. Therefore, the marking media may be secured within the cavity immediately before use, without the need to pre-assemble the arrow and the marking media with an adhesive, nor requiring sufficient time for the adhesive to dry. Additionally, since the marking media is secured immediately before use, the marking media may be stored in a protective sleeve, thereby eliminating the need to protect the assembled arrow and marking media during transport prior to use.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 13 is a cross sectional side view of a cone;

FIG. 14 is a side view of an alternative embodiment of the arrowhead assembly;

FIG. 15 is an exploded side view of the alternative embodiment of the arrowhead assembly;

FIG. 23 is a side view of the third alternative embodiment of the arrowhead assembly;

FIG. 24 is a perspective view of a pad carrier for the third alternative embodiment of the arrowhead assembly;

FIG. 25 is a rear plan view of the pad carrier shown in FIG. 24;

FIG. 26 is a cross sectional view of the pad carrier along cut line 26-26 shown in FIG. 25;

DETAILED DESCRIPTION OF THE INVENTION

Figure 1:
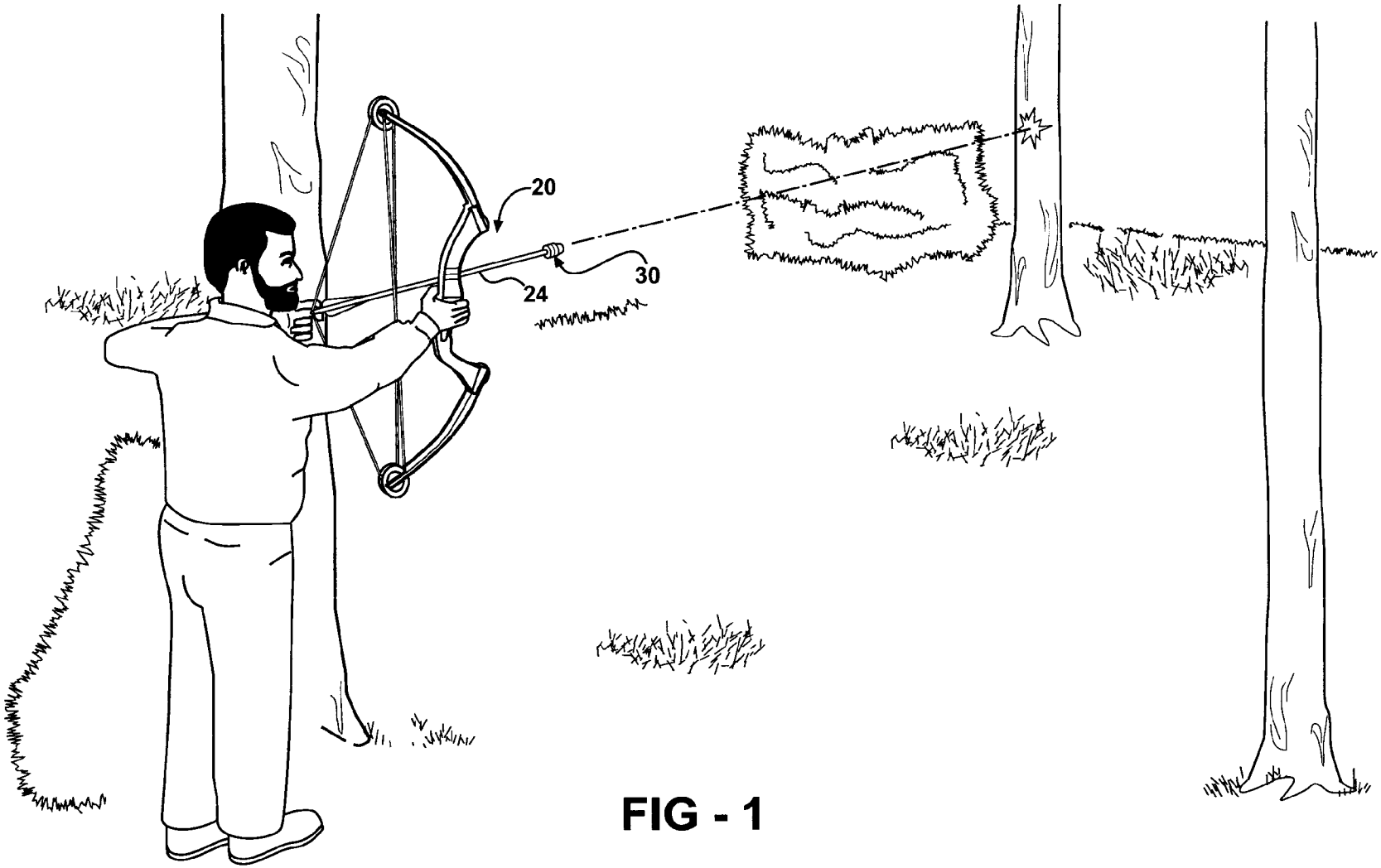
FIG. 1 is a perspective view of an archer launching an arrow.

Referring to the Figures, wherein like numerals indicate corresponding parts throughout the several views, an arrow is generally shown at 20. Referring to FIG. 1, the arrow 20 remotely delivers a marking media 22 to a location. The marking media 22 is preferably a paint ball, such as is commonly utilized with a compressed air gun, or a scent ball, such as described in U.S. Pat. No. 5,303,496 to Kowalkowski, titled "Scent Distributing Method For Hunters". The marking media 22 typically includes a liquid, a gel, a powder, or some other similar medium encapsulated by a container, or in the case of the paint ball or scent ball a hardened outer shell, to hold the medium until ruptured and dispersed. The marking media 22 (preferably either the paint ball or the scent ball) preferably includes a spherical shape having a diameter of 0.68 inches, i.e., a 68 caliber ball. It should be understood that the marking media 22 may include a diameter other than the preferred diameter of 0.68 inches and a shape other than the preferred spherical shape, and still fall within the scope of the claims.

Figure 2:
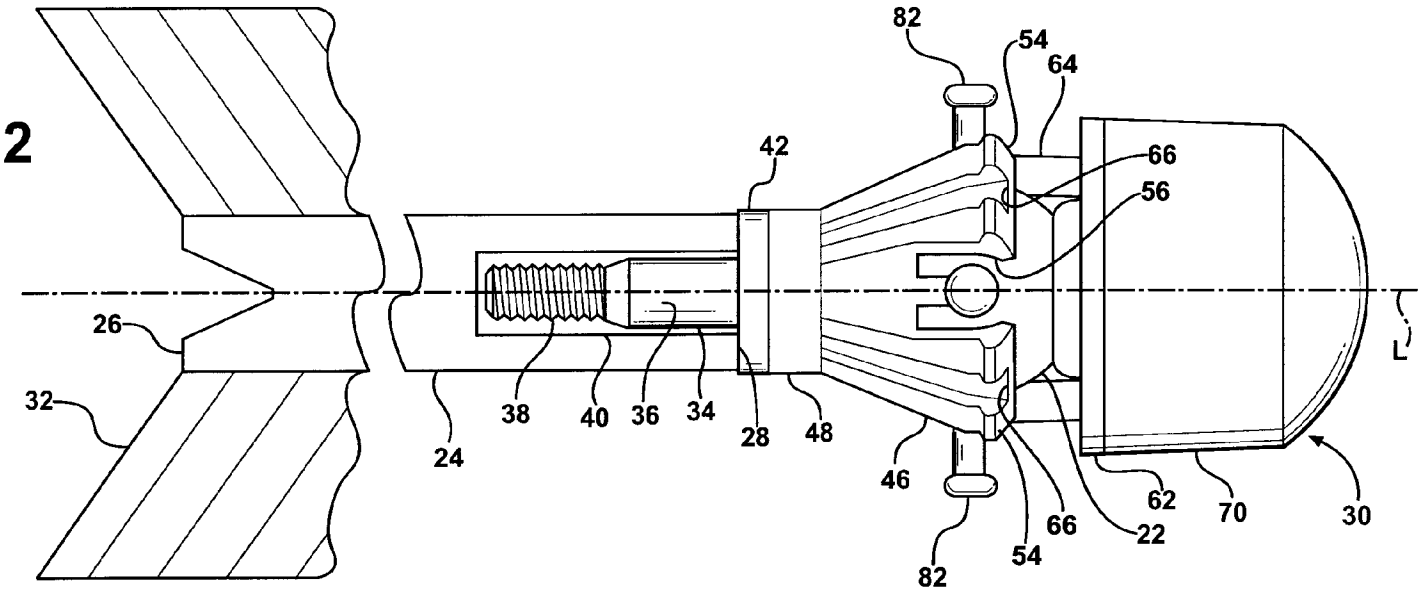
FIG. 2 is a side view of the arrow.

Referring to FIG. 2, the arrow 20 includes a shaft 24 having a nock end 26. The shaft 24 extends from the nock end 26 along a longitudinal axis L to an opposing distal end 28. An arrowhead assembly 30 is attached to the distal end 28 of the shaft 24. Fletching 32 is attached to the shaft 24 near the nock end 26 of the shaft 24.

Figure 3:
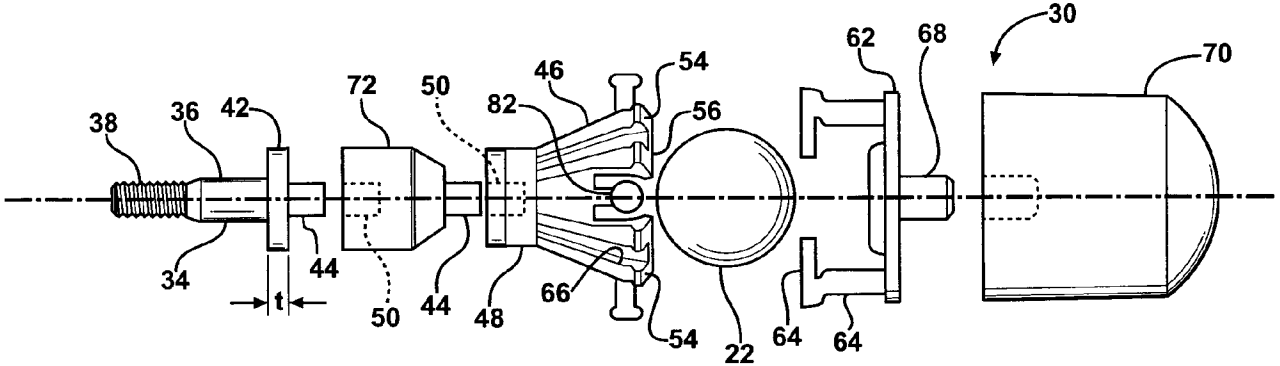
FIG. 3 is an exploded side view of an arrowhead assembly.
Figure 4:
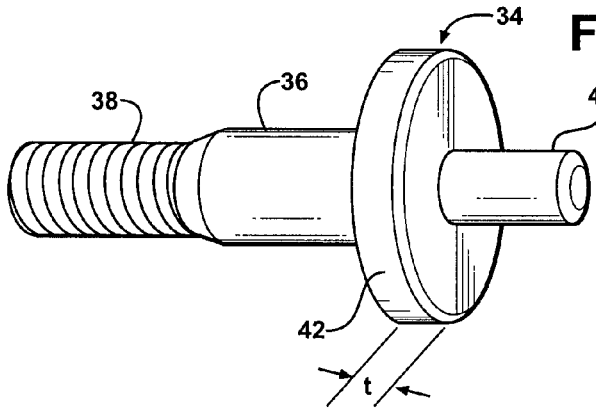
FIG. 4 is perspective view of an arrowhead connector.
Figure 5:
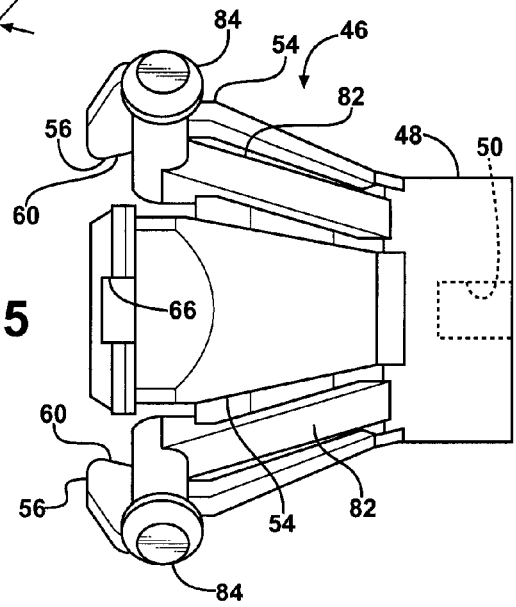
FIG. 5 is a side view of a media reservoir.
Figure 6:
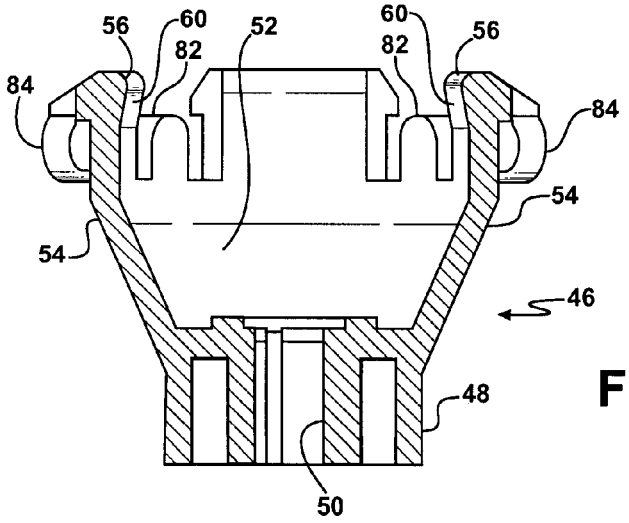
FIG. 6 is a cross sectional view of the media reservoir along cut line 6-6 shown in FIG. 5.
Figure 7:
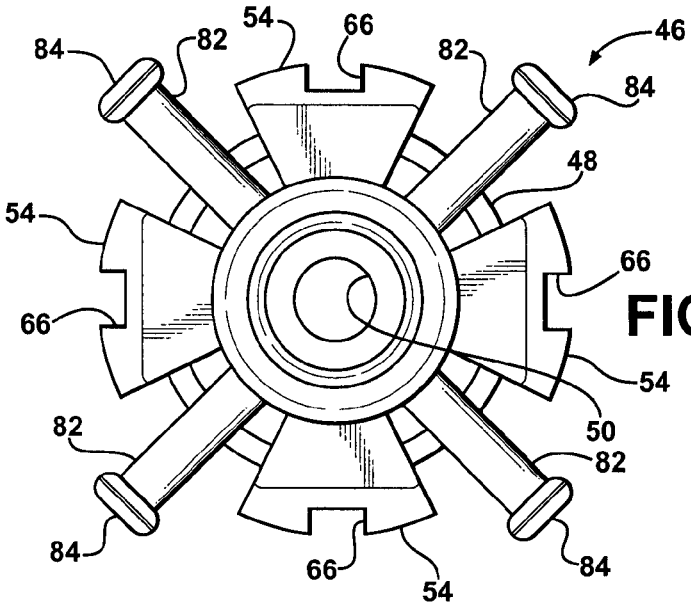
FIG. 7 is a front view of the media reservoir.
Figure 8:
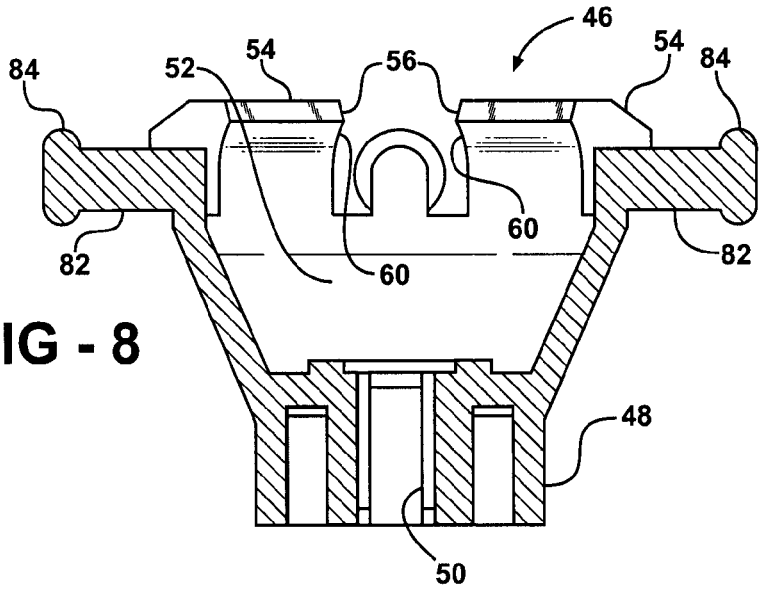
FIG. 8 is a cross sectional view of the media reservoir along cut line 8-8 shown in FIG. 7.

Also referring to FIGS. 3 and 4, the arrow 20 includes an arrowhead connector 34 interconnecting the shaft 24 of the arrow 20 and the arrowhead assembly 30. Preferably, and as shown in the Figures, the arrowhead connector 34 includes an elongate portion 36 having a threaded end 38 for threaded insertion into a receiving plug 40 (often referred to as an arrow insert) disposed within the distal end 28 of the shaft 24. A flange 42 extends radially outward from the elongate portion 36. A peg 44 is concentric with the elongate portion 36 and extends outward from the flange 42. The arrowhead connector 34 is preferably manufactured from a durable material to withstand the impact during use and permit re-use of the arrowhead connector 34. Preferably, the arrowhead connector 34 is aluminum, or a similar metal. Additionally, when manufactured from an aluminum material, the flange 42 of the arrowhead connector 34 preferably includes a thickness t of at least one tenth of an inch, so as to not break during impact, however, the thickness t of the flange 42 may vary depending upon specific design considerations. It should be understood that the arrowhead connector 34 may be configured otherwise than described above and shown in the Figures and still fall within the scope of the claims.

Referring to FIGS. 2, 3, and as best shown in FIGS. 5 through 8, the arrowhead assembly 30 further includes a media reservoir 46. The media reservoir 46 includes a base 48 connected to the arrowhead connector 34 near the distal end 28 of the shaft 24. The base 48 is supported by the flange 42 of the arrowhead connector 34. The base 48 of the media reservoir 46 further includes a bore 50 for slideably engaging the peg 44 of the arrowhead connector 34 in a push fit connection, thereby connecting the arrowhead connector 34 and the media reservoir 46, and allowing for easy replacement of the media reservoir 46 after each use, while also permitting re-use of the arrow 20. Other mechanical connections may also be utilized to secure the media reservoir 46 to the arrowhead connector 34 other than specifically described herein. The connection between the arrowhead connector 34 and the media reservoir 46 being interchangeable with other components described below for situating the other components between the arrowhead connector 34 and the media reservoir 46 if so desired. The media reservoir 46 defines a cavity 52 for supporting the marking media 22. At least one support 54, but preferably a plurality of supports 54 extends outwardly from the base 48 of the media reservoir 46, along the longitudinal axis L. The supports 54 secure the marking media 22 within the cavity 52 of the media reservoir 46 between the supports 54 in a press-fit connection. Accordingly, the marking media 22 is pressed into the cavity 52 between the supports 54, with the supports 54 holding the marking media 22 in place. Each of the plurality of supports 54 include a lip 56 for engaging the marking media 22. The lips 56 on the supports 54 assist in retaining the marking media 22 between the supports 54.

As noted above, the marking media 22 preferably includes a spherical body defining a diameter of 0.68 inches. As such, the lips 56 on the supports 54 are spaced from the base 48 a distance greater than one-half the diameter of the spherical body, i.e., greater than 0.34 inches. Each of the lips 56 are disposed a distance less than the diameter of the spherical body from any other of the lips 56, i.e., less than 0.68 inches. This ensures that the lips 56 extend beyond the largest portion of the marking media 22, trapping the marking media 22 between the base 48 of the media reservoir 46 and the lips 56 on the support 54. Accordingly, when pressing the marking media 22 into the cavity 52, it is necessary for the supports 54 and/or the outer wall of the marking media 22 to flex to allow entry of the marking media 22 into the cavity 52. After which, the supports 54 and/or the outer wall of the marking media 22 return to their respective original and natural shape. It should be understood that the scope of the claims is not limited to the exact dimensions of the preferred embodiment described herein.

Additionally, the supports 54 include an interior curvilinear surface 60 complimentary to the spherical body of the marking media 22 to cradle the spherical body of the marking media 22 between the curvilinear surfaces of the supports 54. It should be understood that if the marking media 22 includes a shape other than spherical, the supports 54 may include an interior surface complimentary thereto.

Upon the arrow 20 impacting the target, inertia drives the flange 42 of the arrowhead connector 34 into the base 48 of the media reservoir 46, rupturing the marking media 22 and fracturing the media reservoir 46. In so doing, if the marking media 22 is a paint ball, the marking media 22 releases paint, which splatters onto the target to indicate the shot placement of the arrow 20. If the marking media 22 is a scent ball, scent splatters onto the target to emanate therefrom. It should be understood that the media reservoir 46 is destroyed by the impact and not reusable. However, the arrow 20 and the arrowhead connector 34 may be retrieved and reused with a new arrowhead assembly 30 and a new marking media 22.

Figure 11:
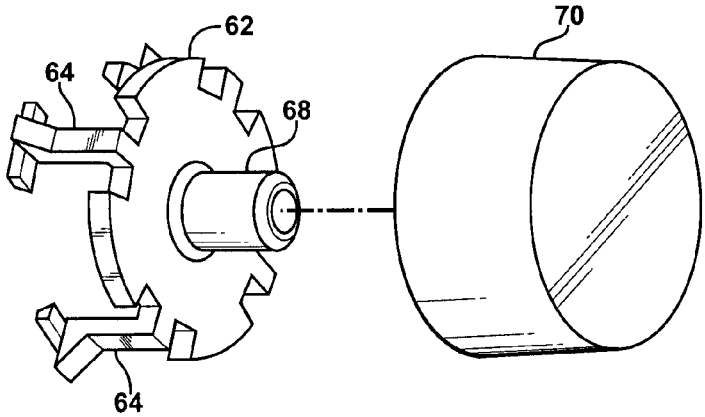
FIG. 11 is a perspective view of a cap.
Figure 12:
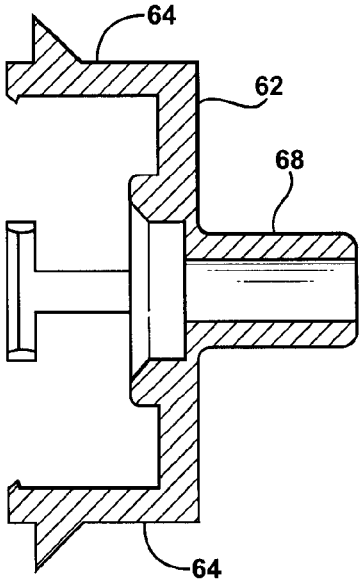
FIG. 12 is a cross sectional side view of the cap.
Figure 16:
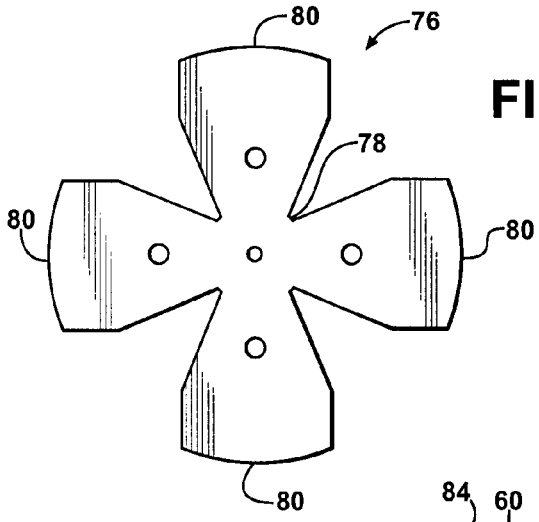
FIG. 16 is a plan view of a pad utilized in the alternative embodiment of the arrowhead assembly.

Referring to FIGS. 2 and 3, and as best shown in FIGS. 11 and 12, a cap 62 may optionally be attached to the media reservoir 46. When the cap 62 is attached to the media reservoir 46, the cap 62 cooperates with the media reservoir 46 to further define the cavity 52 between the media reservoir 46 and the cap 62, with the marking media 22 disposed and surrounded by the base 48 of the media reservoir 46, the supports 54, and the cap 62. The cap 62 includes a plurality of detents 64, which extend toward the supports 54. Each of the supports 54 defines a recess 66 for receiving one of the detents 64 in a snap fit connection. The cap 62 includes a stud 68 extending outward along the longitudinal axis L. Also referring to FIG. 13, a nose cone 70 is attached to the cap 62 by frictional engagement with the stud 68 on the cap 62. The nose cone 70 is disposed opposite the cavity 52, and absorbs energy upon impacting a surface. The nose cone 70 includes a resilient material to bounce off or otherwise dissipate energy from the impact with the target. Accordingly, the arrow 20, when equipped with the cap 62 and the nose cone 70, permits targeting of wild game animals, without the fear of injuring or damaging the game animal.

Figure 9:
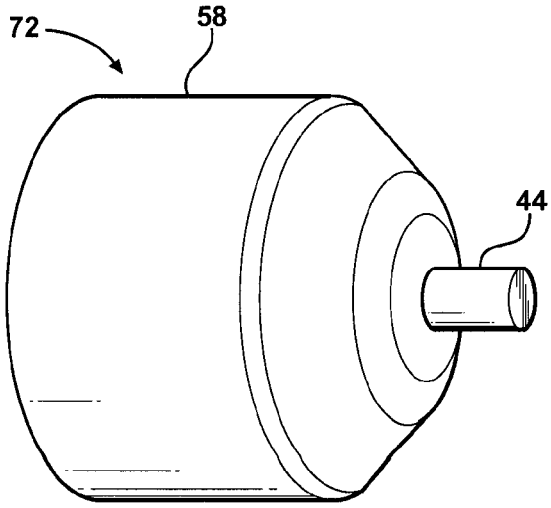
FIG. 9 is a perspective view of an energy dissipating device.
Figure 10:
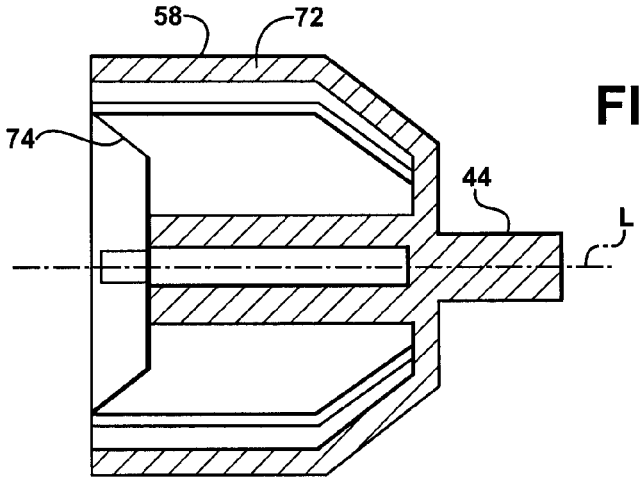
FIG. 10 is a cross sectional view of the energy dissipating device.

Referring to FIG. 3, and as best shown in FIGS. 9 and 10, the arrowhead assembly 30 may further include a frangible energy dissipating device 72. The energy dissipating device 72 reduces an amount of energy transmitted to the shaft 24 of the arrow 20 upon impact, thereby protecting the shaft 24 from damage and permitting re-use of the arrow 20. The energy dissipating device 72 is preferably disposed between the arrowhead connector 34 and the media reservoir 46. The energy dissipating device 72 includes an outer wall 58 and at least one vein 74 extending inward toward the longitudinal axis L from the outer wall 58 for fracturing the outer wall 58 in response to the shaft 24 advancing forward into the energy dissipating device 72. The energy dissipating device 72 includes a bore 50 identical to the bore 50 defined by the media reservoir 46 for disposition over the peg 44 on the arrowhead connector 34, thereby interconnecting the arrowhead connector 34 and the energy dissipating device 72 in a push fit connection. The energy dissipating device 72 further includes a peg 44 identical to the peg 44 on the arrowhead connector 34 for disposition within the bore 50 defined by the media reservoir 46, thereby interconnecting the energy dissipating device 72 and the media reservoir 46 in a push fit connection. Accordingly, the arrowhead assembly 30 utilizes the same type of connection between the arrowhead connector 34 and the media reservoir 46, as between the arrowhead connector 34 and the energy dissipating device 72, as well as between the energy dissipating device 72 and the media reservoir 46, thereby permitting the archer to choose whether or not to use the energy dissipating device 72 in the arrowhead assembly 30. Upon impact, the flange 42 of the arrowhead connector 34 advances forward into the energy dissipating device 72, thereby crushing the vein 74. In so doing, a predetermined amount of energy is dissipated from the arrow 20, thereby reducing the amount of energy the shaft 24 would otherwise have to withstand. It should be understood that the outer wall 58 may fracture as a result of the flange 42 crushing the vein 74.

Referring to FIGS. 14 through 17, in a first alternative embodiment, a pad 76 is attached to the media reservoir 46. The pad 76 cooperates with the media reservoir 46 to further define the cavity 52 between the media reservoir 46 and the pad 76. Preferably, and as shown in the Figures, the pad 76 includes a central portion 78 and a plurality of wings 80 extending from the central portion 78. The media reservoir 46 includes a plurality of posts 82 extending outward from the base 48 along the longitudinal axis L. The posts 82 include an upstanding ridge 84 disposed on each of the posts 82 for securing the wings 80 to the posts 82.

The pad 76 includes an absorbent material, such as a felt or cotton material for absorbing the marking media 22 upon impact, and also for carrying additional marking media (in addition to the marking media 22) to the target. The additional marking media may include a liquid applied to the pad 76, and may be similar in composition to the marking media 22 are may be of a different composition than the marking media 22. The marking media 22 in the first alternative embodiment includes a sent ball, as described above. Accordingly, the scent ball is disposed within the cavity 52, surrounded by the base 48, the supports 54, and the pad 76. The wings 80 of the pad 76 wrap around the scent ball and the supports 54, covering a portion of the supports 54 and attaching to the posts 82 of the media reservoir 46. If additional marking media is applied to the pad 76 prior to launching the arrow, the additional marking media may include a scent similar to the scent ball or may include some other marking material, such as paint. It should be understood that the pad 76 may include other materials capable of absorbing the scent from the scent ball and/or carrying an additional marking media, and may also be shaped otherwise than specifically described herein.

Figure 17:
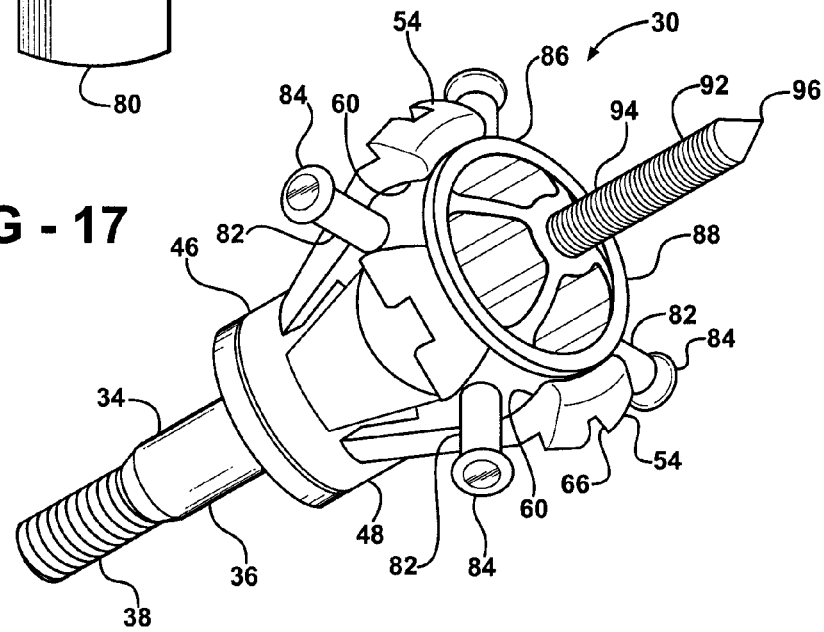
FIG. 17 is a perspective view of a second alternative embodiment of the arrowhead assembly.
Figure 18:
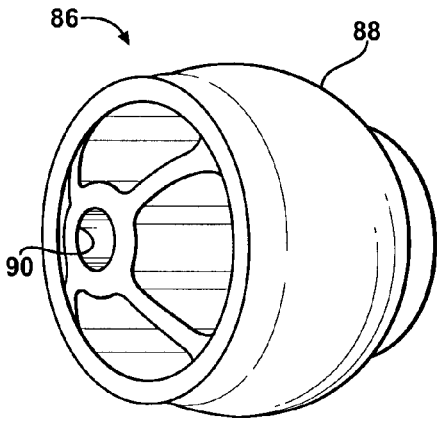
FIG. 18 is a perspective view of an attachment device utilized in the second alternative embodiment of the arrowhead assembly.
Figure 19:
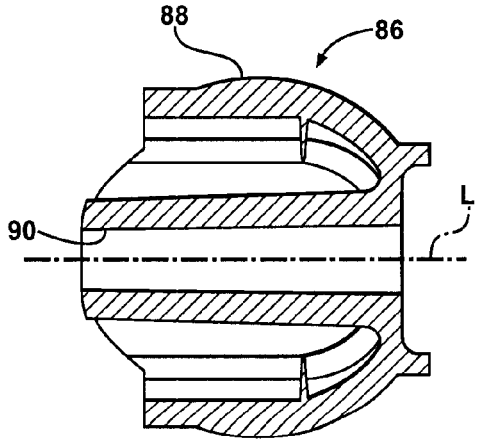
FIG. 19 is a cross sectional side view of the attachment device.

Referring to FIGS. 17 through 19, in a second alternative embodiment, an attachment device 86 is disposed within the cavity 52 for attaching the pad 76 to a surface. The attachment device 86 is disposed within the cavity 52 in lieu of the marking media 22. The pad 76 is attached to the posts 82 of the media reservoir 46 as described in the first alternative embodiment. The attachment device 86 includes a spherical housing 88 supported between the supports 54 in the media reservoir 46, similar to the paint ball or the scent ball as described above. The attachment device 86 defines a central bore 90 through the spherical housing 88, and includes a spike 92 having a shank 94 partially disposed within the central bore 90 and presenting a point 96 extending outward from the spherical housing 88. The pad 76 includes an opening 98 for passing the shank 94 of the spike 92 therethrough. Accordingly, upon impact with the target, the spike 92 will penetrate and stick to the target, pinching the pad 76 between the housing 88 of the attachment device 86 and the target. In the second alternative embodiment, the marking media 22 includes a liquid scent applied directly to the pad 76 just prior to launching the arrow 20.

Figure 20:
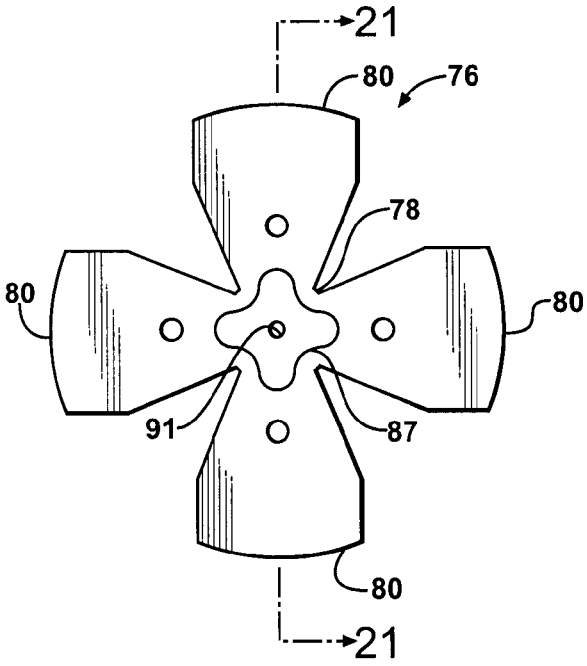
FIG. 20 is a side view of an alternative embodiment of the attachment device on the pad shown in FIG. 16.
Figure 21:
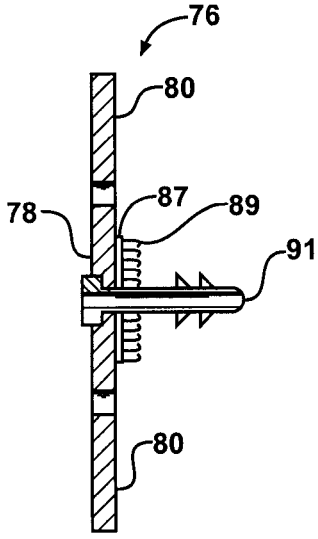
FIG. 21 is a cross sectional side view taken along cut line 21-21 shown in FIG. 20.

Referring to FIGS. 20 and 21, an alternative embodiment of the attachment device 86 is disclosed. This alternative embodiment of the attachment device is intended for attaching the pad 76 to a fur coat of an animal. The alternative embodiment of the attachment device 86 includes an attachment sheet 87, coupled to the central portion 78 of the pad 76. The attachment sheet 87 includes a plurality of hooks 89, and is preferably a hook portion of a loop and hook connection, commonly sold under the trademark VELCRO, by Velcro Industries B.V. The attachment sheet 87 may be coupled to the pad 86 by an adhesive, or alternatively may be sewn onto the pad 86. It should be understood that the attachment sheet 87 may be coupled to the pad by some other method not specifically enumerated herein. An attachment nail 91 extends through the pad 76 and the attachment sheet 87. The attachment nail 91 is long enough to penetrate the fur of the animal, yet short enough so as not to penetrate the flesh of the animal. The attachment sheet 87 and the attachment nail 91 may be covered in grease, which aids in the attachment of the pad 76 to the fur coat of the animal.

Figure 22:
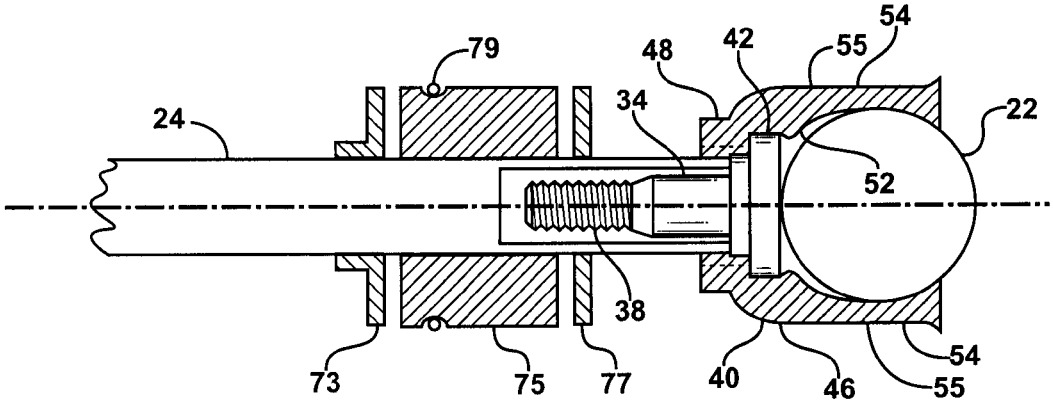
FIG. 22 is a cross sectional side view of a first alternative embodiment of the media reservoir and an alternative embodiment of the energy dissipating device.
Figure 27:
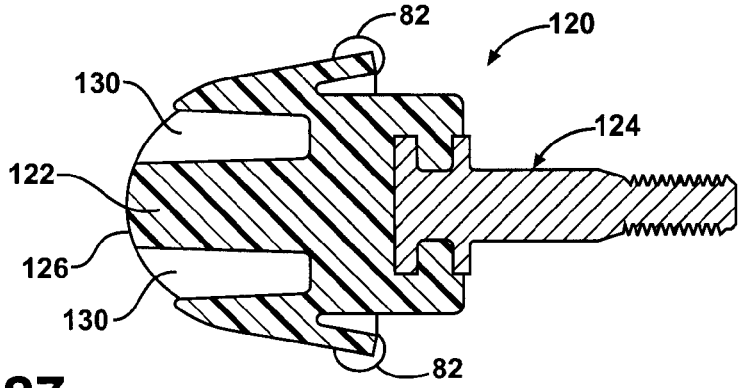
FIG. 27 is a cross sectional view of the pad carrier along cut line 27-27 shown in FIG. 25.

Referring to FIG. 22, an alternative embodiment of the media reservoir 46, along with an alternative embodiment of the energy dissipating device 72 is disclosed. The alternative embodiment of the media reservoir 46 is formed from a resilient material, such as a hard rubber, so as to not fracture upon impact. It should be understood that the alternative embodiment of the media reservoir 46 may include some other material that will not fracture upon impact with the surface, thereby permitting re-use of the media reservoir 46. The support 54 includes a wall 55 extending around an outer periphery of the base 48. Accordingly, the wall 55 defines the cavity 52 to be generally cup shaped, for supporting the marking media 22 therein. The base 48 of the media reservoir 46 is disposed about the flange 42 of the arrowhead connector 34 in a push fit connection. The alternative embodiment of the energy dissipating device 72 includes a first flat washer 73 disposed over the shaft 24 of the arrow 20 in a tight push fit connection so as to not slide over the shaft 24 of the arrow 20 upon impact. Alternatively, the first washer 73 may be otherwise rigidly attached to the shaft 24 of the arrow 20 by some other mechanically connection or adhered to the shaft 24 by a chemical adhesive. A cushion 75 is disposed over the shaft 24, between the first washer 73 and the media reservoir 46. The cushion 75 includes a resilient, compressible material, such as a rubber or a foam, for absorbing energy upon impact. A cable tie 79 (zip tie) secures the cushion 75 to the shaft 24. A second washer 77 is disposed over the shaft 24 between the cushion 75 and the media reservoir 46 to spread the force exerted upon the energy dissipating device 72 evenly over the cushion 75. The alternative embodiment of the energy dissipating device 72 is positioned along the shaft 24 so that the media reservoir 46 may move along the shaft 24, compressing the cushion 75, while not allowing the arrowhead connector 34 to contact the surface upon impact.

Referring to FIGS. 23 through 27, a third alternative embodiment of the arrowhead assembly 120 is shown. The third alternative embodiment of the arrowhead assembly 120 remotely delivers a scented pad 76 to a location by the arrow 20. The pad 76, described above and shown in FIG. 16, carries by absorption a scent as also described above.

The third alternative embodiment of the arrowhead assembly 120 includes a pad carrier 122 and a first alternative embodiment of the arrowhead connector 124, described in greater detail below. The first alternative embodiment of the arrowhead connector 124 is preferably manufactured from aluminum, and the pad carrier 122 is preferably manufactured from a polymer. The pad carrier 122 is coupled to the first alternative embodiment of the arrowhead connector 124. Preferably, the pad carrier 122 is over-molded onto the first alternative embodiment of the arrowhead connector 124 to fixedly connect the pad carrier to the first alternative embodiment of the arrowhead connector 124.

The pad 76 is attached to the pad carrier 122. The pad carrier 122 includes a cone section 126 for supporting the pad 76 in a semi spherical orientation. The cone section 126 of the pad carrier 122 flexes to absorb energy upon impact with a surface to protect the shaft 24 of the arrow 20 from damage. The cone section 126 includes a plurality of veins 128 defining a plurality of void sections 130 between the veins 128. The veins 128 and the void sections 130 are configured to flex, but not fracture, upon impacting a surface, yet are sufficiently stiff to support the pad 76 in the semi-spherical orientation during flight of the arrow 20 after the arrow 20 is launched.

The third alternative embodiment of the arrowhead assembly 120 further comprises an attachment mechanism 132 interconnecting the pad 76 and the pad carrier 122. As described above, the pad 76 includes a central portion 78 and a plurality of wings 80 extending from the central portion 78. Preferably, the attachment mechanism 132 includes a plurality of posts 82 disposed on the pad carrier 122 extending outward from a base 48. The posts 82 secure the wings 80 of the pad 76 to the pad carrier 122. Alternatively, the attachment mechanism 132 may include a loop and hook fastening system, commonly referred to as Velcro. As such, one of the loop side and the hook side is attached to one of the pad carrier 122 and the pad 76 by an adhesive, and the other of the loop side and the hook side is attached to the other of the pad carrier 122 and the pad 76 respectively.

Figure 28:
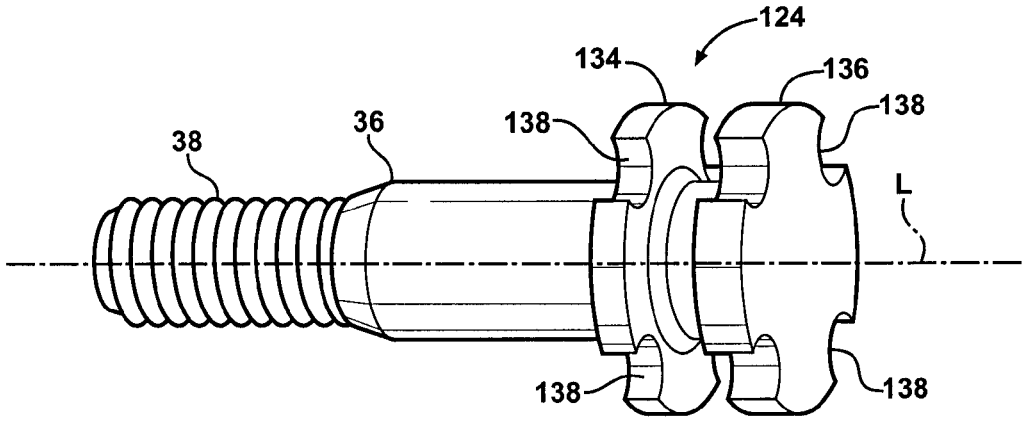
FIG. 28 is a perspective view of a first alternative embodiment of the arrowhead connector.
Figure 29:
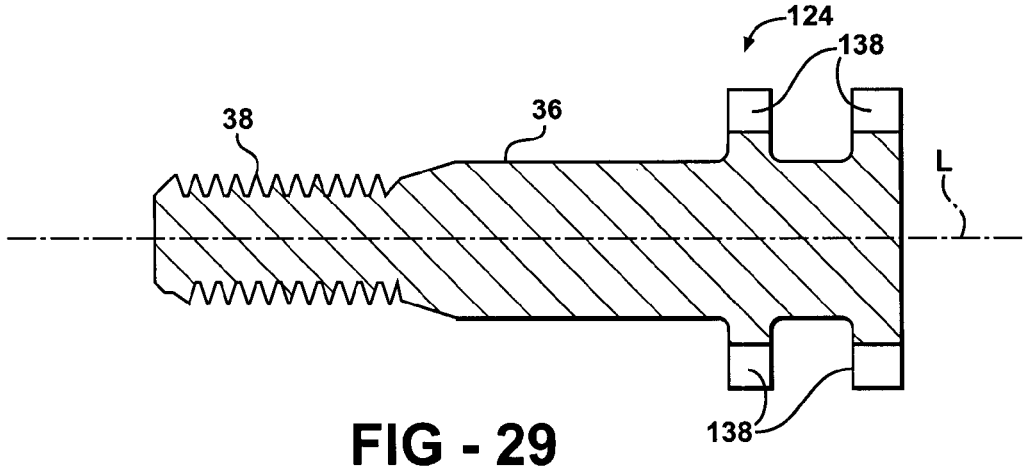
FIG. 29 is a cross sectional view of the first alternative embodiment of the arrowhead connector shown in FIG. 28.
Figure 30:
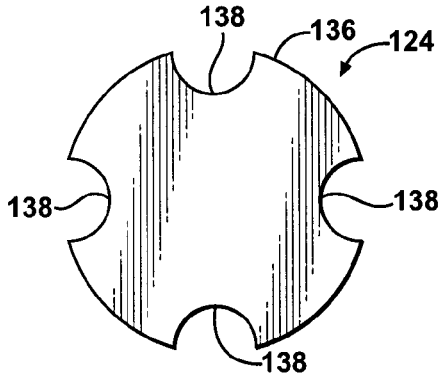
FIG. 30 is an end plan view of the first alternative embodiment of the arrowhead connector shown in FIG. 28.
Figure 31:
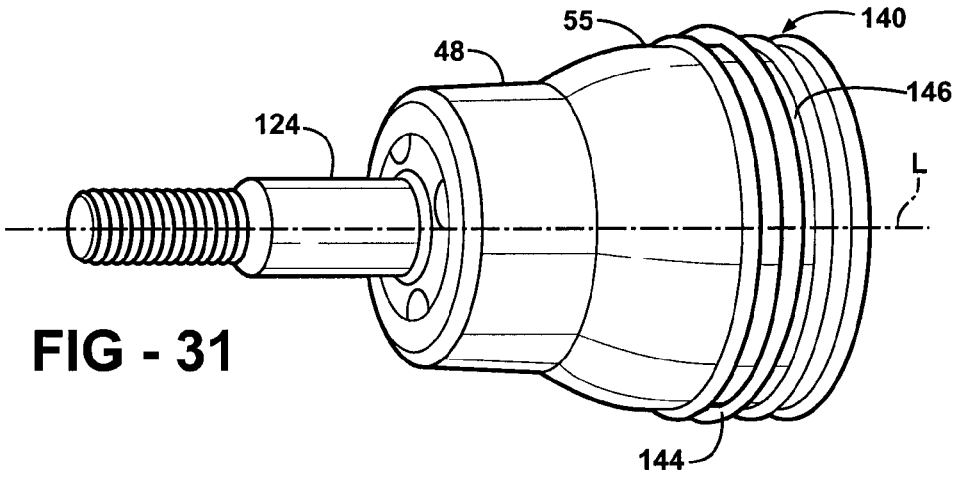
FIG. 31 is a side perspective view of a second alternative embodiment of the media reservoir coupled to the first alternative embodiment of the arrowhead connector shown in FIG. 28.

Referring to FIGS. 28-30, the first alternative embodiment of the arrowhead connector 124 is shown. The first alternative embodiment of the arrowhead connector 124 is for coupling to the shaft 24 of the arrow 20 as is well known. The first alternative embodiment of the arrowhead connector 124 is configured to facilitate over-molding of various polymer components onto the first alternative embodiment of the arrowhead connector 124 to fixedly connect the various components to the first alternative embodiment of the arrowhead connector 124.

The first alternative embodiment of the arrowhead connector 124 extends along the longitudinal axis L, and includes an elongate portion 36 having a threaded end 38 for threaded insertion into a receiving plug 40 of the arrow 20. A first flange 134 and a second flange 136 extend radially outward from the elongate portion 36 in spaced parallel relationship relative to each other. Preferably, the first flange 134 and the second flange 136 include a generally circular shape radially about the longitudinal axis L. However, it should be appreciated that the first flange 134 and the second flange 136 may include a different shape. Each of the first flange 134 and the second flange 136 include a plurality of locking edges 138. As shown, each of the first flange 134 and the second flange 136 include four locking edges 138 equally spaced from each other about the longitudinal axis L, i.e., spaced approximately ninety degrees from each other about the longitudinal axis L. The locking edges 138 engage the various components that are over-molded onto the first alternative embodiment of the arrowhead connector 124 to prevent rotation of the various components about the longitudinal axis L relative to the first alternative embodiment of the arrowhead connector 124. It should be appreciated that the first alternative embodiment of the arrowhead connector 124 may be configured differently to accept an over-molded component and prevent rotation of the component relative to the first alternative embodiment of the arrowhead connector 124.

Referring to FIGS. 31 through 34, a second alternative embodiment of the media reservoir 140 is shown. The second alternative embodiment of the media reservoir 140 is fixedly connected to the first alternative embodiment of the arrowhead connector 124, i.e., the second alternative embodiment of the media reservoir 140 is over-molded onto the first alternative embodiment of the arrowhead connector 124.

The second alternative embodiment of the media reservoir 140 includes a base 48, with a wall 55 extending outwardly from the base 48 around a periphery of the base 48 along the longitudinal axis L. The wall 55 defines a spherical cup shaped cavity 52 for securing the marking media 22 within the cavity 52 in a press-fit connection, i.e., the wall 55 biases against the spherical shaped marking media 22 to hold the marking media 22 within the cup shaped cavity 52.

Figure 32:
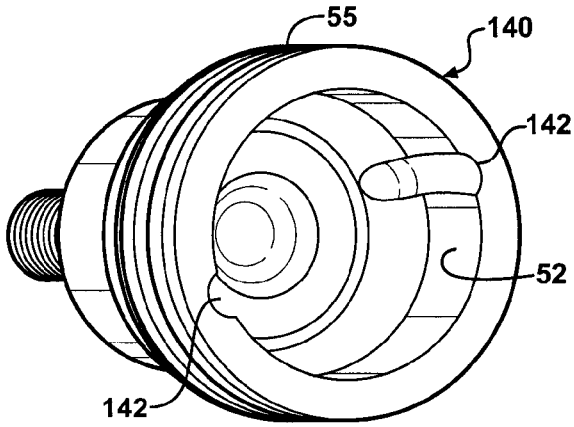
FIG. 32 is a frontal perspective view of the second alternative embodiment of the media reservoir shown in FIG. 31.
Figure 33:
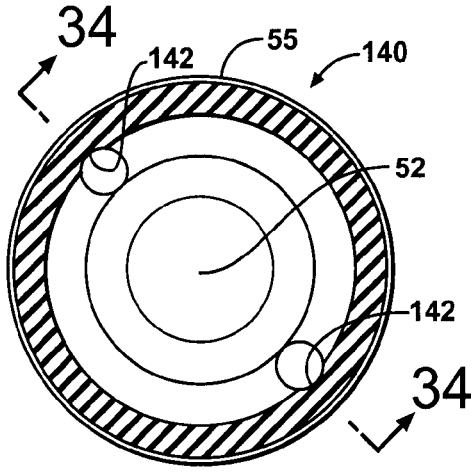
FIG. 33 is a frontal plan view of the second alternative embodiment of the media reservoir shown in FIG. 31.
Figure 34:
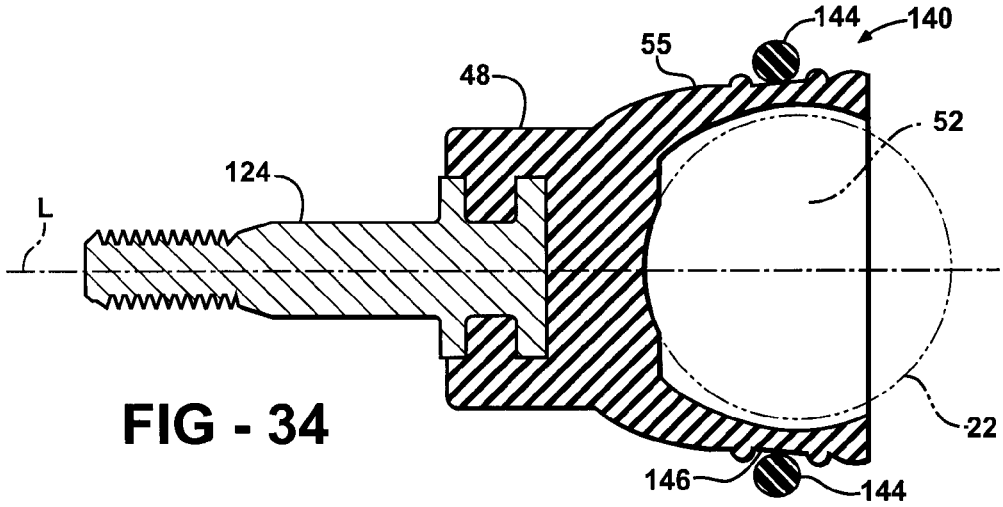
FIG. 34 is a side cross sectional view of the second alternative embodiment of the media reservoir shown in FIG. 31.

As best shown in FIGS. 32 and 33, the wall 55 of the second alternative embodiment of the media reservoir 140 includes at least one groove 142 extending substantially along the longitudinal axis L from the base 48 to a distal end of the wall 55, near an outer edge of the wall 55. Because there is a tight fit between the wall 55 of the second alternative embodiment of the media reservoir 140 and the marking media 22, the groove 142 permits air to escape the cavity 52 as the marking media 22 is loaded into the cavity 52. The groove 142 therefore ensures a proper fit of the marking media 22 within the cavity 52 without any trapped air pockets between the base 48 and the marking media 22. As shown, the second alternative embodiment of the media reservoir 140 includes two grooves 142, with each of the grooves 142 including a semi-circular shape. However, it should be appreciated that the number and configuration of the grooves 142 may be different than shown or described herein.

An elastic sleeve 144 is disposed around an exterior surface of the wall 55, near the distal end of the wall 55, to bias the wall 55 inward to tighten and secure the press-fit connection between the cavity 52 and the marking media 22. Accordingly, the wall 55 defines an annular depression 146 for positioning the sleeve 144 therein. The sleeve 144 may include a rubber o-ring or some other similar device suitable sized to snugly fit the outer surface of the wall 55. The sleeve 144 also permits repeated use of the second alternative embodiment of the media reservoir 140 in the event the wall 55 suffers a tear during continued use, i.e., the sleeve 144 continues to ensure the press-fit connection between the wall 55 and the marking media 22 even if the wall 55 is torn.

The second alternative embodiment of the media reservoir 140 includes a resilient material. The resilient material is preferably a rubber, but may comprise some other suitable material. The resilient material provides some energy absorption capabilities to the arrowhead assembly 30 to help protect the arrowhead assembly 30 and the shaft 24 of the arrow 20 from damage upon impact with a surface. The second alternative embodiment of the media reservoir 140 is ideal for use against hard surfaced objects. Accordingly, the resilient material may include a rubber having a ninety (90) Shore A durometer. However, it should be appreciated that the resilient material may include other types of materials, such as a three component urethane having a ninety (90) Shore A durometer. It should also be appreciated that the hardness may also be other than the ninety (90) Shore A durometer described above and still fall within the scope of the subject invention.

Figure 35:
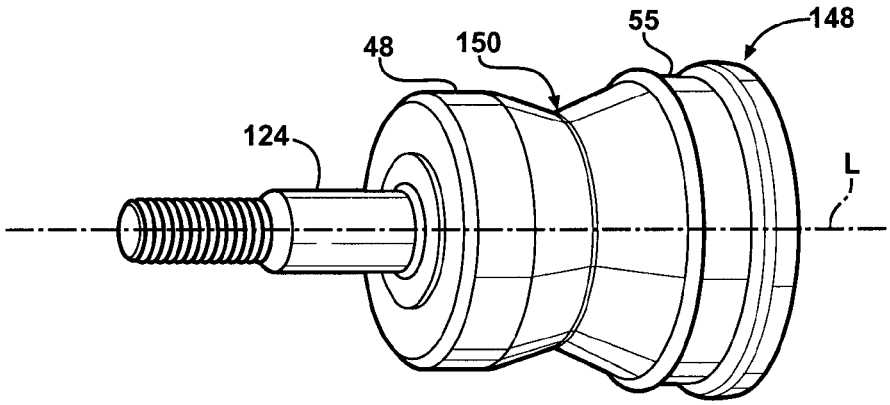
FIG. 35 is a perspective view of a third alternative embodiment of the media reservoir coupled to the first alternative embodiment of the arrowhead connector shown in FIG. 28.
Figure 36:
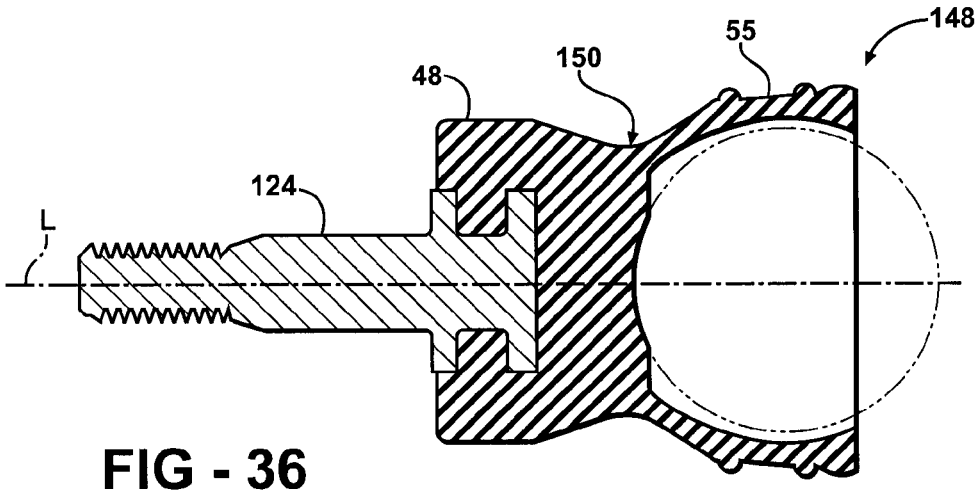
FIG. 36 is a side cross sectional view of the third alternative embodiment of the media reservoir shown in FIG. 35 before impacting a surface.
Figure 37:
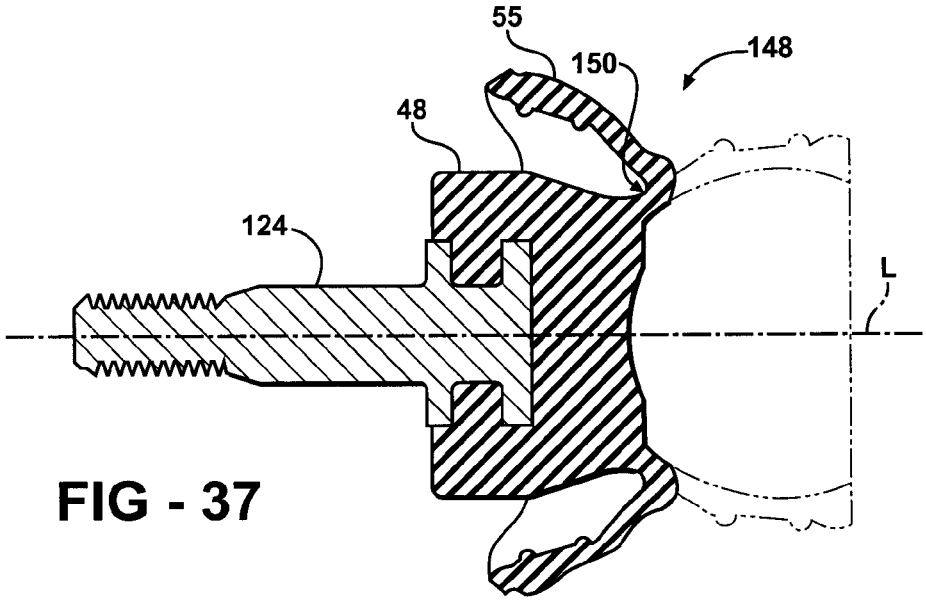
FIG. 37 is a side cross sectional view of the third alternative embodiment of the media reservoir shown in FIG. 35 after impacting a surface.

Referring to FIGS. 35-37, a third alternative embodiment of the media reservoir 148 is shown. The third alternative embodiment of the media reservoir 148 includes a tapered central section 150 disposed between the base 48 and the distal end of the wall 55. The central section 150 is configured to allow the wall 55 to fold backward over the base 48 upon impacting a surface. The third alternative embodiment of the media reservoir 148 is ideal for use on softer objects, such as game animals that the archer does not wish to harm, but merely mark, and is also ideally suited for youth arrows having inserts and shot from bows having a draw weight of forty pounds (40 lbs) or less. Having the wall 55 fold back over the base 48 permits the marking media 22 to be dispersed over a larger area, thereby permitting easier visual recognition of the marked object.

The third alternative embodiment of the media reservoir 148 includes a resilient material. The resilient material is preferably a rubber, but may comprise some other suitable material. The resilient material provides some energy absorption capabilities to the arrowhead assembly 30 to help protect the arrowhead assembly 30 and the shaft 24 of the arrow 20 from damage upon impact with a surface. The resilient material may include a rubber having an eighty (80) Shore A durometer. However, it should be appreciated that the resilient material may include other types of materials, such as a three component urethane having a eighty (80) Shore A durometer. It should also be appreciated that the hardness may also be other than the eighty (80) Shore A durometer described above and still fall within the scope of the subject invention.

Figure 38:
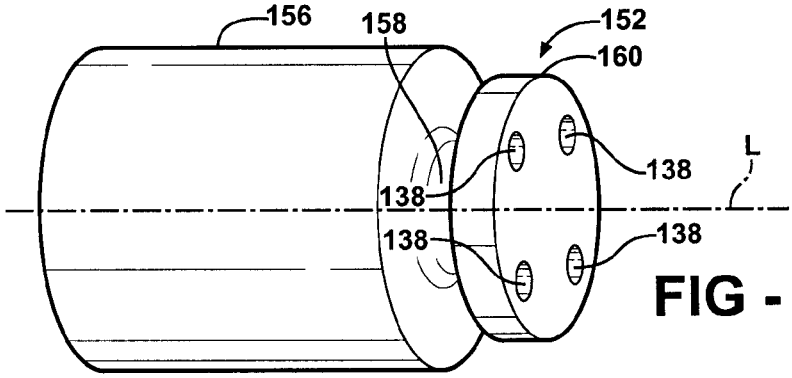
FIG. 38 is a perspective view of a second alternative embodiment of the arrowhead connector.
Figure 39:
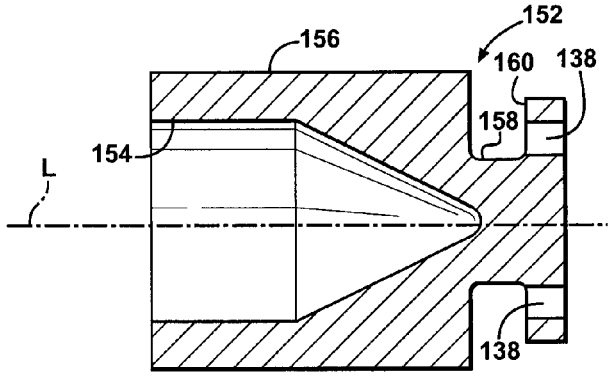
FIG. 39 is a side cross sectional view of the second alternative embodiment of the arrowhead connector shown in FIG. 38.

Referring to FIGS. 38 and 39, a second alternative embodiment of the arrowhead connector 152 is shown. The second alternative embodiment of the arrowhead connector 152 comprises and is manufactured from aluminum. The second alternative embodiment of the arrowhead connector 152 defines a pocket 154 for slideably receiving a pointed end of the arrow therein. Accordingly, the second alternative embodiment of the arrowhead connector 152 is ideally suitable for use with a youth arrow, which are typically outfitted only with a generally pointed tip and do not include the receiving plug 40 (arrow insert) as do the arrows intended for sue in bows having a draw weight greater than forty pounds (40 lbs). However, it should be appreciated that the second alternative embodiment of the arrowhead connector 152 may be utilized with an arrow 20 having the receiving plug 40. The second alternative embodiment of the arrowhead connector 152 is manufactured from aluminum to prevent the pointed tip of the youth arrow 20 from driving through the arrowhead assembly 30 upon impacting a surface.

The second alternative embodiment of the arrowhead connector 152 includes a barrel portion 156 and a collar portion 158, with the collar portion 158 having a smaller diameter than a diameter of the barrel portion 156. A collar flange 160 extends radially outward from the collar portion 158, and includes a plurality of locking edges 138. As shown, the locking edges 138 include four apertures arranged radially about the longitudinal axis and equally spaced from each other. It should be appreciated that the number and configuration of the locking edges 138 may vary from that shown and described herein. As described above, the locking edges 138 prevent rotation of various components over-molded onto the second alternative embodiment of the arrowhead connector 152 relative to the second alternative embodiment of the arrowhead connector 152.

Figure 40:
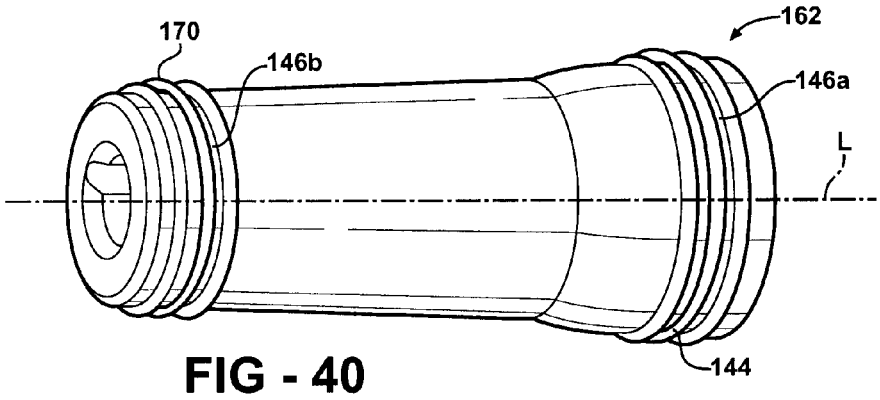
FIG. 40 is a perspective view of a fourth alternative embodiment of the media reservoir assembly.
Figure 41:
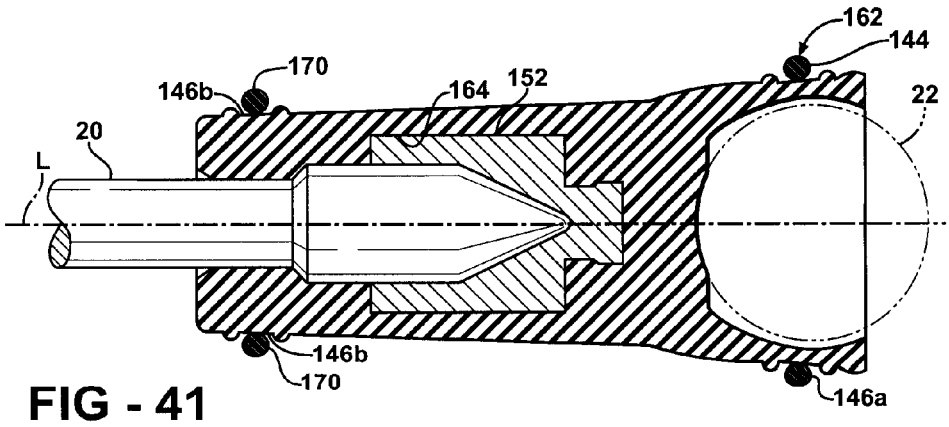
FIG. 41 is a side cross sectional view of the fourth alternative embodiment of the media reservoir assembly shown in FIG. 40 attached to the second alternative embodiment of the arrowhead connector shown in FIG. 38.

Referring to FIGS. 40 and 41, a fourth alternative embodiment of the media reservoir 162 is shown. The fourth alternative embodiment of the media reservoir 162 is ideally suited for use with the second alternative embodiment of the arrowhead connector 152 shown in FIGS. 38 and 39 and described above. Preferably, the fourth alternative embodiment of the media reservoir 162 is over-molded onto the second alternative embodiment of the arrowhead connector 152 to fixedly connect the fourth alternative embodiment of the media reservoir 162 to the second alternative embodiment of the arrowhead connector 152. The fourth alternative embodiment of the media reservoir 162 defines an interior chamber 164 with the second alternative embodiment of the arrowhead connector 152 disposed within the interior chamber 164. The pointed tip of the youth arrow 20 is inserted into the interior chamber 164 and the second alternative embodiment of the arrowhead connector 152 therein. The fourth alternative embodiment of the media reservoir 162 includes a first annular depression 146*a* near the distal end of the wall 55 and a second annular depression 146*b* near the interior chamber 164. An elastic sleeve 144 is disposed within the first annular depression 146*a* around the exterior of the wall 55 to bias the wall 55 inward to tighten the press-fit connection between the cavity 52 and the marking media 22. A tie strap 170 is disposed within the second annular depression 146*b* and fixedly secures the fourth alternative embodiment of the media reservoir 162 to the shaft 24 of the youth arrow 20.

Referring to FIGS. 42 through 45, an archery target 172 is shown. The target 172 is for an arrow 20 having an arrowhead assembly 30 attached thereto containing a marking media 22 therein, such as described above. The target 172 comprises a plate 174 comprising an impact resistant material. The plate 174 includes a first surface 176 and an opposite second surface 178. The plate 174 may include any hardened material capable of preventing a launched arrow 20 from passing through the plate 174, including wood, metal, or plastic. Preferably, the plate 174 includes a polymer. More preferably, the polymer includes polypropylene having a thickness of 0.050 inches. The 0.050 inch thick polypropylene plate 174 provides the sufficient impact resistance to prevent puncture while also permitting the plate 174 to be bent around a support (not shown), such as a tree. Bending the plate 174 around the support provides uniform stability to the target 172 and improves impact dynamics across the entire area of the target 172.

A padding layer 180 is attached to the first surface 176 of the plate 174. The padding layer 180 may be attached by any suitable method including fasteners, staples, or preferably an adhesive. Preferably, the padding layer 180 includes an absorbent material. More preferably, the absorbent material includes a cotton fabric such as a cotton duck. It should be appreciated that other materials may also be utilized for the padding layer 180.

An overlay 182 is attached to the plate 174, adjacent the padding layer 180, and sandwiches the padding layer 180 between the overlay 182 and the first surface 176 of the plate 174. The overlay 182 includes indicia 184 thereon. The indicia 184 may represent a simple circular target having varying gradations and distance markings, or the indicia 184 may represent some other target, such as a game animal. The overlay 182 includes a film, with the indicia 184 printed on the film. Preferably, the film includes vinyl, however it should be appreciated that the film may include some other material capable of having the indicia 184 printed thereon and suitable for use with the marking media 22, i.e., permitting easy removal of the marking media 22 after the arrow 20 contacts the target 172.

The plate 174, the padding layer 180 and the overlay 182 cooperate to define an outer perimeter 186 and at least one aperture 188 near the outer perimeter 186. The aperture 188 facilitates connection of the target 172 to a support, such as a tree, hay bale or some other suitable support. The target 172 includes a grommet 190 disposed within the at least one aperture 188. Preferably, the target 172 includes at least one ear 192 extending outwardly from the outer perimeter 186 with the at least one aperture 188 disposed within the at least one ear 192. As shown the target 172 includes two ears 192 radially opposing each other on opposite sides of the target 172.

Figure 42:
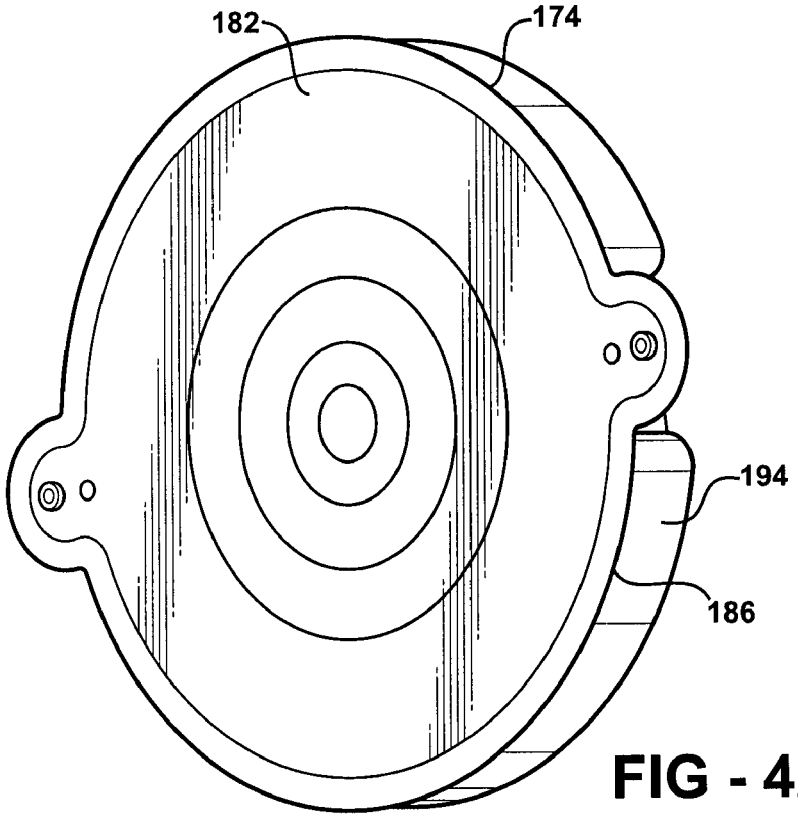
FIG. 42 is a perspective view of a target assembly
Figure 43:
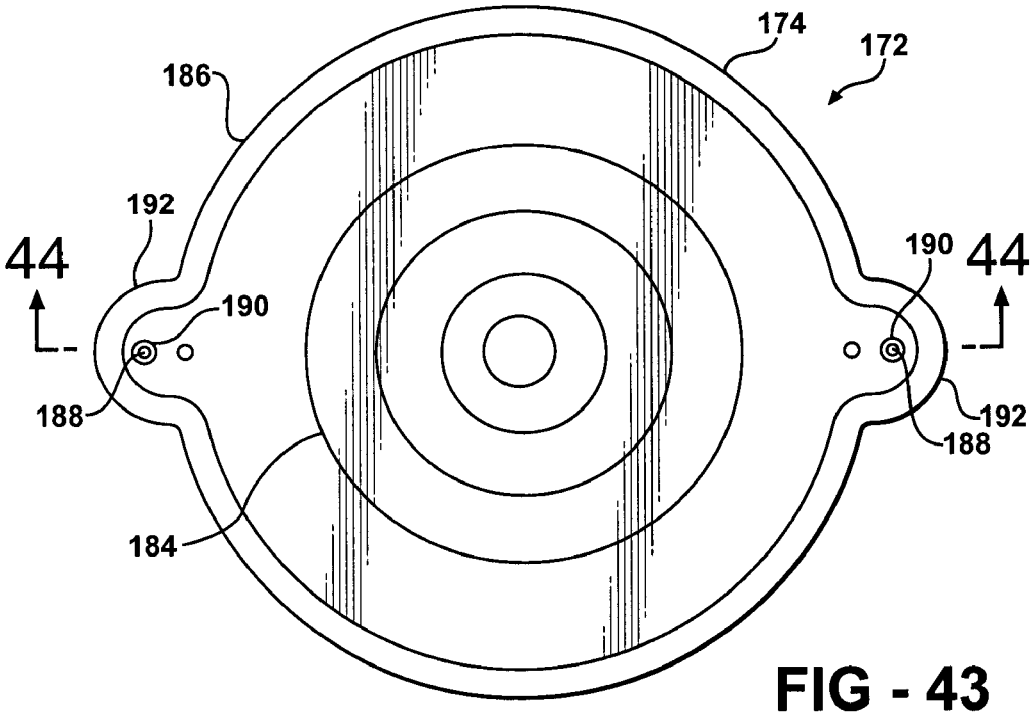
FIG. 43 is a frontal plan of the target assembly shown in FIG. 42.
Figure 44:
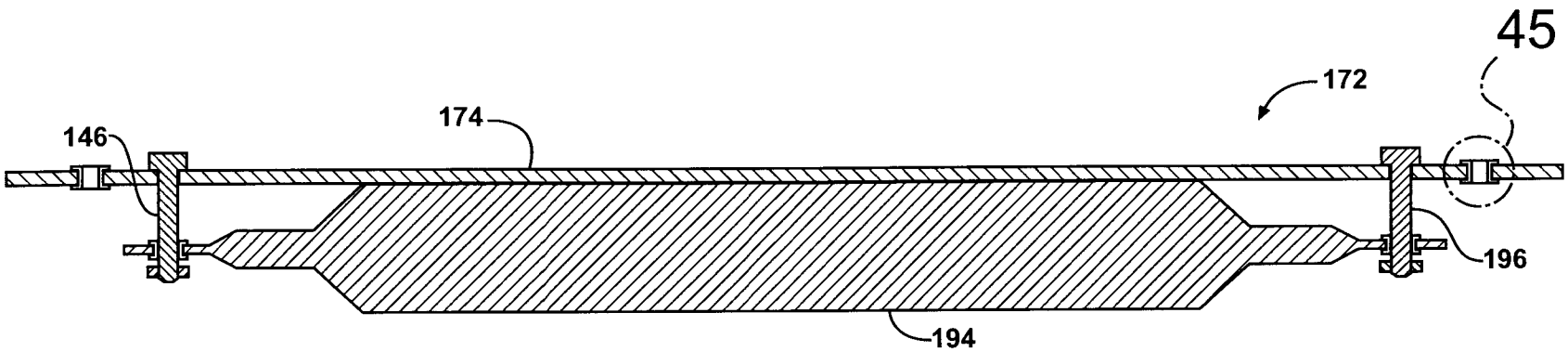
FIG. 44 is a cross sectional view of the target assembly along cut line 44-44 shown in FIG. 43.
Figure 45:
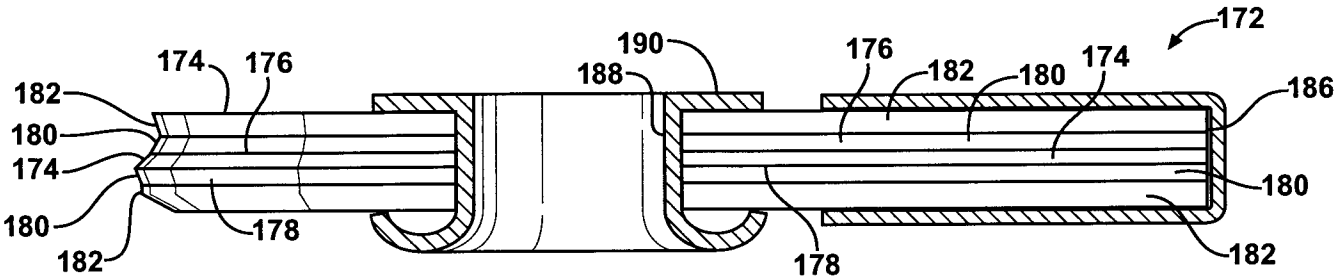
FIG. 45 is an enlarged fragmentary cross sectional view of the target assembly shown in FIG. 44.

The target 172 may further comprise a cushion 194 disposed against the second surface 178 of the plate 174 for absorbing energy transmitted to the plate 174 from the arrow 20. The cushion 194 is especially suited for use with today's high-powered bows. Preferably, the cushion 194 includes a foam material. However, it should be understood that the cushion 194 may include some other material suitable for absorbing energy when the target 172 is impacted by the arrow 20. The cushion 194 may be attached to the plate 174 by fasteners 196 as shown in FIGS. 42 and 44, or may be attached by other methods such as an adhesive.

The foregoing invention has been described in accordance with the relevant legal standards; thus, the description is exemplary rather than limiting in nature. Variations and modifications to the disclosed embodiments may become apparent to those skilled in the art and do come within the scope of the invention. Accordingly, the scope of legal protection afforded this invention can only be determined by studying the following claims.

What is claimed is:

1. An arrowhead assembly for remotely delivering a scented pad to a location by an arrow having a shaft, said assembly comprising:

an arrowhead connector extending along a longitudinal axis for coupling to the shaft of the arrow;

a pad carrier coupled to said arrowhead connector;

a pad attached to said pad carrier for carrying a scent;

said pad carrier including a convex spherical cone section for supporting said pad in a convex semi spherical orientation;

an attachment mechanism interconnecting said pad and said pad carrier; and said pad includes a central portion and a plurality of wings extending from said central portion and said attachment mechanism includes a plurality of posts disposed on said pad carrier extending outward from said base for securing said plurality of wings to said plurality of posts.

2. An assembly as set forth in claim 1 wherein said attachment mechanism includes a loop and hook fastening system.

3. An assembly as set forth in claim 1 wherein said cone section of said pad carrier is flexible to absorb energy upon impact with a surface.

4. An assembly as set forth in claim 1 wherein said arrowhead connector and said pad carrier are fixedly connected together.

5. An arrowhead assembly for remotely delivering a frangible marking media having a spherical body defining a diameter to a location by an arrow having a shaft, said assembly comprising:

an arrowhead connector extending along a longitudinal axis for coupling to the shaft of the arrow;

a media reservoir coupled to said arrowhead connector and including a base; and a continuous circumferential wall extending outwardly from said base of said media reservoir around a periphery of said base along a longitudinal axis and defining a spherical cup shaped cavity having an outer edge defining a diameter perpendicular to said longitudinal axis less than the diameter of the marking media and spaced from said base a distance greater than one half the diameter of the marking media to secure the marking media within said cavity in a press-fit connection.

6. An assembly as set forth in claim 5 wherein said wall includes at least one groove extending substantially along said longitudinal axis from said base to a distal end of said wall.

7. An assembly as set forth in claim 6 further comprising an elastic sleeve disposed around an exterior of said wall to bias the wall inward to tighten the press-fit connection between said cavity and the marking media.

8. An assembly as set forth in claim 7 wherein said wall defines an annular depression for positioning said sleeve therein.

9. An assembly as set forth in claim 7 wherein said arrowhead connector and said media reservoir are fixedly connected together.

10. An assembly as set forth in claim 9 wherein said arrowhead connector includes a first flange and a second flange spaced from said first flange along said longitudinal axis and said bore of said media reservoir defines a first annular groove and a second annular groove with said first flange disposed within said first annular groove and said second flange disposed within said second annular groove.

11. An assembly as set forth in claim 9 wherein said media reservoir includes a resilient material.

12. An assembly as set forth in claim 11 wherein said resilient material includes a urethane material having a durometer equal to eighty (80) Shore A.

13. An assembly as set forth in claim 11 wherein said resilient material includes a urethane material having a durometer equal to ninety (90) Shore A.

14. An assembly as set forth in claim 6 wherein said media reservoir includes a tapered central section allowing said wall to fold backward over said base upon impacting a surface.

15. An assembly as set forth in claim 6 wherein said media reservoir defines an interior chamber with said arrowhead connector disposed within said interior chamber.

16. An assembly as set forth in claim 15 wherein said arrowhead connector comprises aluminum.

17. An assembly as set forth in claim 16 wherein said arrowhead connector defines a pocket for slideably receiving a pointed end of the arrow shaft therein.

18. An assembly as set forth in claim 17 further comprising a tie strap for fixedly securing said media reservoir to the shaft of the arrow.

19. An assembly as set forth in claim 18 further comprising an elastic sleeve disposed around an exterior of said wall to bias the wall inward to tighten the press-fit connection between said cavity and the marking media.

* * * * *